United States Patent [19]

Reneault et al.

[11] 4,228,624

[45] Oct. 21, 1980

[54] HEAT-SOUND INSULATING WALL

[75] Inventors: Patrick Reneault, Garches; Francis Ovaert, Paris, both of France

[73] Assignee: SMAC ACIEROID, Paris, France

[21] Appl. No.: 5,017

[22] Filed: Jan. 19, 1979

[30] Foreign Application Priority Data

Jan. 26, 1978 [FR] France ..... 78 02128

[51] Int. Cl.[3] ..... E04B 1/82

[52] U.S. Cl. ..... 52/145; 52/335; 52/404; 52/588

[58] Field of Search ..... 52/145, 588, 404, 332, 52/335

[56] References Cited

U.S. PATENT DOCUMENTS

| | | | |
|---|---|---|---|
| 1,994,439 | 3/1935 | Slidell | 52/145 |
| 2,098,717 | 11/1937 | Calkins et al. | 52/588 |
| 2,271,871 | 2/1942 | Newport et al. | 52/145 |
| 3,304,680 | 2/1967 | Birdwell | 52/335 |
| 4,120,123 | 10/1978 | Knudson | 52/588 |

*Primary Examiner*—James L. Ridgill, Jr.

*Attorney, Agent, or Firm*—Wenderoth, Lind & Ponack

[57] ABSTRACT

The wall comprises a closed acoustic box-structure which is defined by a slightly ribbed sheet and a flat sheet. The box-structure has lateral ribs which extend beyond the sheet. A panel of high-density mineral wool which is of small thickness is enclosed inside the box-structure. A heat insulator covers the box-structure and the ribs of the box-structure and is protected by an outer trough which has ribs or corrugations perpendicular to the ribs of the box-structure.

8 Claims, 1 Drawing Figure

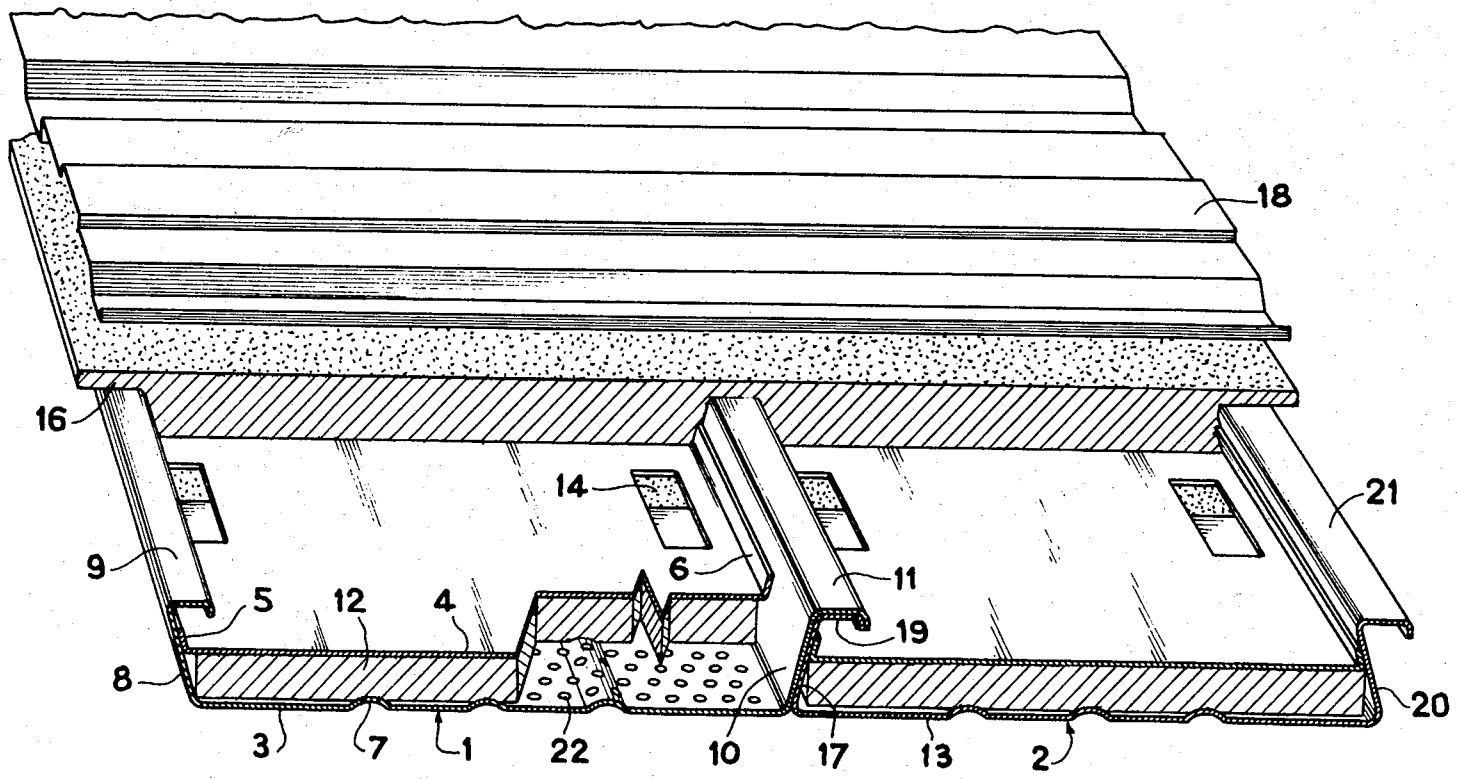
18
21
20
2
13
11
19
17
10
6
14
22
1
4
7
12
3
5
8
9
16

HEAT-SOUND INSULATING WALL

At the present time, it is increasingly frequent to ensure the heat insulation of buildings, and more particularly industrial buildings, by placing on the structure of metal or concrete of the building an insulating wall formed by a metal inner covering, a heat insulator, usually of mineral wool, and a ribbed or corrugated outer covering. Sometimes, the inner covering is perforated with regular orifices so as to permit an absorption of the sounds by the insulating material and thereby improve the acoustic comfort of the premises.

However, it is found that this acoustic improvement is limited to noise of medium and high frequency and, on the contrary, the presence of the perforated sheet reduces the acoustic performances as concerns the insulation against aerial noises so that the transmission of the noise between the interior and the exterior of the buildings is increased.

Tests carried out involving an increase in the thickness of the insulator or a reinforcement of the sheets of the inner or outer covering have encountered problems of construction concerning the production of these means themselves or the manner in which they are fixed. It is indeed important that the thickness of the wall be relatively small and that the number of fixing means be as limited as possible owing to the risk of formation of a heat bridge or leakages of noise.

An object of the present invention is to satisfy these requirements by providing a wall which ensures both a heat insulation and a sound insulation which are practically continuous with no risk of formation of a heat bridge, and an acoustic correction in the premises closed by these walls.

According to the invention, there is provided an insulating wall which comprises a closed acoustic box-structure having one side which is slightly ribbed whereas the other side is flat and which carries lateral ribs. A thin panel of mineral wool of high density is enclosed in this box-structure; and a relatively thick heat insulator covers the box-structure and the ribs and is protected by an outer trough or panel which is ribbed or corrugated, these ribs or corrugations being perpendicular to the ribs of the box-structure.

Preferably, the heat insulator is formed by a light felt, whereas the panel of mineral wool is of high density so as to improve the absorbing qualities in the low and medium frequencies. Moreover, the flat sheet of the acoustic box-structure has a thickness which is relatively large and adapted to the required insulation.

In such a wall, the heat insulating felt is held in position by the ribs of the box-structure. It is preferably in a single piece and is merely maintained at its ends and at the points at which the outer trough is hooked to the ribs.

There is thus provided a wall which, notwithstanding the presence of perforations on the inner side of the box-structure, provides an insulation against aerial noises which are stopped by the combination of the mineral wool, the unperforated sheet and the outer layer or covering which is separated by the heat insulator, the acoustic correction inside the premises and the heat insulation.

The advantages and features of the invention will be apparent from the ensuing description of an embodiment of the invention which is given merely by way of example and shown in the single FIGURE of the accompanying drawing which shows a wall portion in section with a part cut away.

As shown in the FIGURE, the insulating wall of the invention comprises a box-structure element or, according to a preferred embodiment, a series of box-structure units which are juxtaposed and assembled with each other. Each box-structure 1 or 2 comprises a sheet 3 which is folded into a U-sectional shape in which is fitted a second sheet 4 parallel to the sheet 3. The sheet 4 has a thickness greater than that of the sheet and includes two folded edge portions 5 and 6 which bear against the flanges 8 and 10 which extend from the mid-portion of the U-section sheet 3. The sheet 4 is mechanically fixed, for example by welding or riveting or other means, to the sheet 3 in the region of the flanges 8 and 10, forming in this way a closed box-structure. The sheet 3 is provided with corrugations 7 or more precisely small ribs produced by a forming operation and constituting stiffeners. Moreover, it is preferably perforated while the sheet 4 is unperforated and planar.

Inside the box-structure defined by the sheet 3 and 4 and the flanges 8 and 10, is a panel of high-density mineral wool 12. The thickness of this panel 12 is distinctly less than the length or extent of the flanges 8 and 10 of the sheet 3 so that these flanges extend beyond the sheet 4. The ends 9 and 11 of the flanges 8 and 10 are both formed over in the same direction so as to constitute a rib which projects from the sheet 4.

Preferably, and as shown in the FIGURE, the box-structure 1 has flanges 8 and 10 which are divergent whereas the box-structure 2, which is constructed in a similar manner, has a sheet 13 folded into a U-sectioned shape the flanges 17 and 20 of which are convergent. The slope of the lower flange 10 of the box-structure 1 exactly corresponds to the slope of the upper flange 17 of the box-structure 2. Likewise, the slope of the lower flange 20 of the box-structure 2 is similar to that of the upper flange 8 of the box-structure 1. Further, the rib 9 or 19 which extends inwardly of each of the box-strucures has a height greater than the rib 11 or 21 which extends outwardly of the same box-structure. The rib 9 or 19 can thus be easily fitted in the lower rib 11 or 21 of an adjacent box-structure. This fitting together or interlocking of the ribs enables the box-structures to be easily assembled with each other and produces a substantially continuous element. The fitted ribs 19 and 11, for example, also perform the function of horizontal rails which stiffen the assembly and take the loads nnd are advantageous from the strength point of view. This type of section also provides an improved airtightness and therefore improves the sound insulation for the high-pitch frequencies.

The assembly comprising the elements of the same box-structure, that is to say the solid plate 4, the panel of mineral wool 12 and the perforated sheet 3, are fixed to the posts of the building, for example by means of notches 14 formed in the plate 4 through which notches a fixing device extends, or merely by means of screws, bolts or the like, which extend through the three members in succession.

The thickness of the panel 12 is small and always distinctly less than the length or extent of the flanges 8, 10 or 17, 20 of the sheets 3 or 13. Thus, the ribs 9 and 11 project distinctly beyond the sheet 4.

A pad 16 of heat insulating material, for example a non-combustible felt of mineral wool, covers the whole of the box-structures 1 and 2. It is of large thickness and exceeds that of the ribs 9 or 11 so that it provides a continuous protection throughout the length of the wall with no risk of a thermal bridge. This insulating panel 16 is protected on the outside by a ribbed or corrugated trough or panel 18, the ribs or corrugations of which are perpendicular to the ribs 9, 11 of the box-structure. This trough may be covered with a visco-elastic material so as to increase the insulating performance as concerns aerial noises. The choice of the shape of the corrugations or ribs of the trough 18 is determined in accordance with the frequencies of the noises to be stopped. This covering, and the positioning of the panel 16 and the trough 18 itself, are carried out on the building site. On the other hand, the box-structures 1 and 2 and their assembly can be carried out in the factory or on the building site, depending on the circumstances. The thickness of the sheet of the section member 3 or 13 essentially depends on the mechanical stresses to which the wall is subjected. On the other hand, the thickness of the solid flat sheet 4 depends on the desired acoustic performances.

In any case, the heat insulator 16 is in contact with the sheets 4 which are planar, that is to say with a substantially smooth surface, and is merely fitted on the ribs 9 and 11 without requiring special fixing means or the interruption of the heat insulation. The trough or panel 18 is in contact with the insulator 16 only along some of its ribs, that is to say along surfaces perpendicular to the ribs 9 and 11. This trough is held in position by fixing means placed in the bottom of its grooves and extending into the ribs 11 or 9.

With this arrangement, the wall provides an effective heat insulation without a thermal bridge. It also provides a real comfort of the premises owing to the absorption of the noises and in particular noises of low frequency which pass through the perforations 22 of the sheets 3 and 13 and are absorbed by the panel 12. The aerial noises are also stopped by the combination of this panel 12 with the planar sheet 4 which is in regular contact with the heat insulator 16 and with the outer trough 18.

It will be understood that the sheet 13 and the sheet 3 are preferably provided with horizontal corrugattions 7 parallel to the ribs 9 and 11 holding the insulator 12.

A wall of this type may be employed either vertically or horizontally, for example on roofs, the outer trough receiving in the latter case, for example, a sealing support insulator.

In a modification, the walls 3 and 13 are provided with irregular orifices having given diameters in different parts of the sheet so as to increase the absorbing performance. Likewise, the arrangement of the perforations may vary in accordance with the utilization.

The absorbing panel 12 has, for example, a thickness which is one half that of the heat insulator 16, whereas the thickness of the flat sheet 4 is double that of the U-section sheet 3 or 13. The sheet 4 may also have a greater thickness if necessary.

All the component parts of the wall, such as the sheets of the box-structure, the outer trough, the panel and the insulator, are preferably made from a non-combustible material.

Having now described our invention what we claim as new and desire to secure by Letters Patent is:

1. A heat-sound insulating wall which is light and not intended to be used as a load-bearing wall but to be attached to a rigid support structure such as a frame of a building, said insulating wall comprising an acoustic box structure which comprises a substantially U-sectioned sheet which has a mid-portion which defines a first side of the box structure and is slightly ribbed and opposed flange portions which are spaced apart and extend from one side of the mid-portion, and a flat sheet which extends across the whole of the U-sectioned sheet and is wholly spaced from said mid-portion and fixed to the flange portions and defines a second side of the box structure, the flange portions extending beyond said flat sheet relative to said mid-portion and thereby forming rib structures on said second side of the box structure, a thin panel of sound insulating high-density mineral wool which extends across the whole of the box structure from one flange portion to the other opposed flange portion and is disposed in the space between said mid-portion and said flat sheet, a pad of flexible porous material affording a heat insulation and having a weight substantially similar to the heat insulation and weight of an insulating mineral wool felt structure, said pad adjoining the whole of said second side of the box structure and said rib structures and having a thickness which exceeds the thickness of said panel and exceeds the dimension of said rib structures measured from said flat sheet and laterally overlapping the rib structures and an outer panel which bears against and protects said pad and has ribs or corrugations which extend in a direction perpendicular to the ribs of said mid-portion.

2. A wall as claimed in claim 1, comprising box structure means which comprise a plurality of said box structures which are assembled and fitted together by their flange portions which are arranged to interlock, said pad extending across each composite rib structure formed by the interlocking flange portions of adjoining box structures and said outer panel being common to a plurality of box structures so as to extend across the interlocking flange portions with portions of said pad therebetween.

3. A wall as claimed in claim 1 or 2, wherein the slightly ribbed sheet of the box-structure is perforated.

4. A wall as claimed in claim 1 or 2, wherein the heat insulating pad is fitted on the ribs which maintain it in position.

5. A wall as claimed in claim 1 or 2, wherein the heat insulating pad is a felt of non-combustible mineral wool.

6. A wall as claimed in claim 1 or 2, wherein the slightly ribbed U-section sheet has perforations whose sizes differ from one another.

7. A wall as claimed in claim 1, wherein said pad has a thickness which is substantially twice the thickness of said panel of sound insulating high-density mineral wool.

8. A wall as claimed in claim 1 or 7, wherein said flat sheet has a thickness which is substantially twice the thickness of said mid-portion of the U-sectioned sheet.

* * * * *